United States Patent [19]

Venezia

[11] Patent Number: 4,782,582

[45] Date of Patent: Nov. 8, 1988

[54] PROCESS FOR THE MANUFACTURE OF A TOROIDAL BALLAST CHOKE

[75] Inventor: Joseph A. Venezia, Staten Island, N.Y.

[73] Assignee: Eastrock Technology Inc., Edison, N.J.

[21] Appl. No.: 99,667

[22] Filed: Sep. 21, 1987

Related U.S. Application Data

[63] Continuation of Ser. No. 681,493, Dec. 13, 1984, abandoned.

[51] Int. Cl.[4] ..... H01F 41/08

[52] U.S. Cl. ..... 29/605; 336/212; 336/229

[58] Field of Search ..... 29/605, 416, 606; 336/229, 225, 228, 212

[56] References Cited

U.S. PATENT DOCUMENTS

| | | | |
|---|---|---|---|
| 1,832,290 | 11/1931 | Fischer | 336/216 X |
| 1,889,398 | 11/1932 | Bishop | 336/229 X |
| 3,448,421 | 6/1969 | Berg et al. | 336/229 X |

*Primary Examiner*—Carl E. Hall

*Attorney, Agent, or Firm*—Fitzpatrick, Cella, Harper & Scinto

[57] ABSTRACT

A process for the manufacture of a generally toroidal or annular choke, in which a magnetic core is provided with an insulative layer, e.g., by an injection or other molding process, and divided into two parts. Each of the parts is then provided with a respective winding. The two chokes thus made can be electrically connected in series and mechanically joined to form a choke having the shape of the original core. Preferably, the original core is annular and each of the pieces is roughly semi-annular.

7 Claims, 2 Drawing Sheets

Fig. 1.
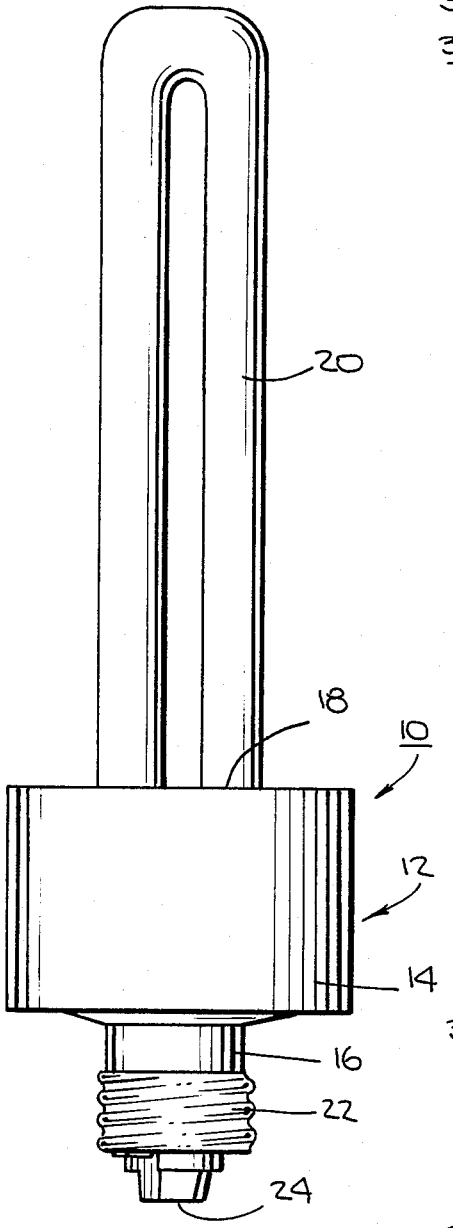
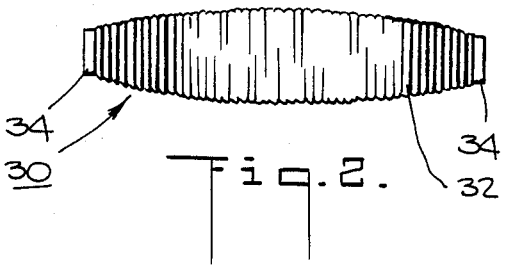
Fig. 2.
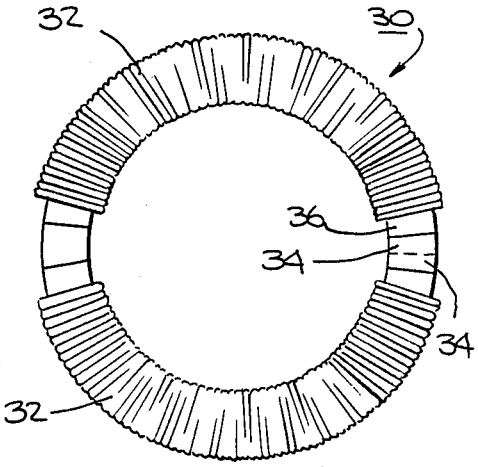
Fig. 3.
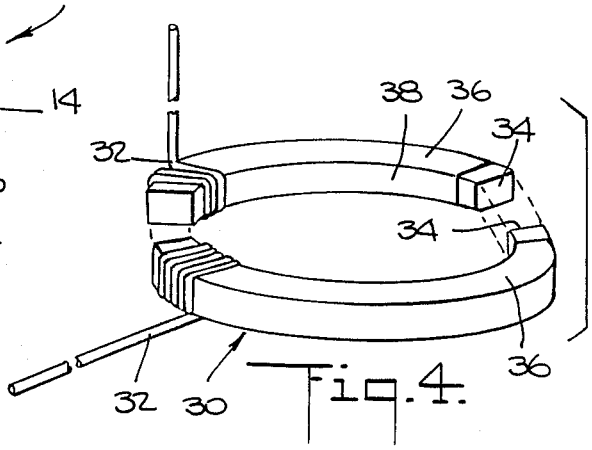
Fig. 4.

PROCESS FOR THE MANUFACTURE OF A TOROIDAL BALLAST CHOKE

This application is a continuation of application Ser. No. 681,493, filed Dec. 13, 1984, now abandoned.

BACKGROUND OF THE INVENTION

The present invention pertains generally to the field of lighting fixtures, and pertains more particularly to a process for manufacturing a generally toroidal ballast choke for use in such a fixture.

As is well known, lighting fixtures intended for use with fluorescent and other bulbs of types with which a ballast choke is used are frequently larger than those for incandescent bulbs of comparable bulk. It is often desirable to reduce the size of such fluorescent and similar fixtures as much as possible, whether to save space, or for reasons of economy or esthetics.

It would also be desirable to have a device by means of which fluorescent bulbs, etc., could be used with ordinary incandescent lamp sockets. Adapters designed for such use have been proposed, as have fluorescent lamps specifically designed for use in incandescent lamp fixtures. For example, U.S. Pat. No. 3,551,736 (Doehner) shows a fluorescent lamp in which a fluorescent bulb rests on a ballast unit and has electrical connector pins which extend through passages provided for them in the ballast unit. The ballast unit also receives electrical connector pins from a terminal contact base which is externally threaded to be screwed into a conventional incandescent lamp screw socket. In that patent, the ballast unit contains a toroidal ballast choke, with the connector pin passages extending through the hole of the torus. The starter and the capacitor are located in the screw base unit.

Conventional methods for manufacturing such devices are expensive because of the difficulty of mass-producing toroidal chokes, particularly because of the difficulty of forming a winding on a toroidal core.

It would be desirable to provide a convenient, simple, reliable and economical process for manufacturing a toroidal choke.

SUMMARY OF THE INVENTION

Accordingly, it is the object of the present invention to provide a simple, reliable, convenient and economical process for manufacturing a generally toroidal choke suitable for use in a socket adapter or other lighting fixture.

As set out in copending, commonly assigned application Ser. No. 681,102, filed on even date herewith, a one-piece lighting fixture, which may be a socket adapter, in which such a choke can suitably be used comprises a one-piece housing having a recess formed therein for receiving the base of a light bulb, electrical circuitry including the ballast choke disposed in the housing, and electrical contact elements for connecting the electrical circuitry with an external power source. If the fixture is a socket adapter, it also has an external securing device for securing it to a socket. Preferably, the electrical circuitry at least partially surrounds the recess, and most preferably the ballast choke is toroidal and surrounds the recess.

According to the process of the present invention, such a ballast choke is manufactured by providing a core made of a magnetic material, forming on the core a layer of an electrically insulative material, dividing the core into two pieces each of which bears a portion of the insulative coating, and wrapping a winding of an electrical conductor on each of the two pieces, with the coating insulating the winding from the core. Preferably, the insulative layer is formed on the core by means of injection molding, or by placing the core in a mold made of a flexible material and introducing the insulative material into the mold, releasing the core by flexing the mold after the insulative material has set. The dividing step is preferably, but not absolutely necessarily, performed after the provision of the insulative layer. The two resulting chokes can be used separately, or can be electrically connected in series with or without a mechanical connection to form, in effect, a single choke having the shape of the original core.

These and other objects and features of the invention will be more clearly and thoroughly understood from the following detailed description of the preferred embodiment, taken in conjunction with the accompanying drawings, in which like reference characters refer to like elements throughout.

BRIEF DESCRIPTION OF THE FIGURES

FIG. 1 is a perspective view of a socket adapter of a type that can advantageously be made by means of the process of the invention, with a fluorescent bulb in place in the adapter.

FIG. 2 is a front elevation view of a toroidal ballast choke used in the socket adapter of FIG. 1.

FIG. 3 is a top plan view of the choke of FIG. 2.

FIG. 4 is an exploded view of the ballast choke of FIG. 2.

DETAILED DESCRIPTION OF THE PREFERRED EMBODIMENTS

Figure 5:
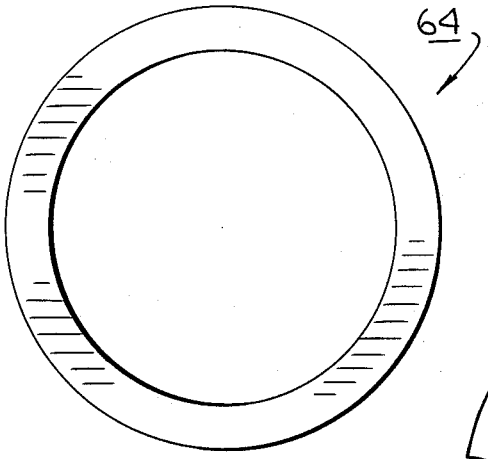
FIG. 5 is a top view of a core from which the choke of FIG. 2 is made.

FIG. 1 shows in perspective a socket adaptor 10 employing a toroidal choke of a type that can advantageously be made by the process of the present invention, with a typical fluorescent bulb of one type, shown by way of example only, in place in the adapter to illustrate the use of the latter. As can be seen, the adapter 10 has a one-piece housing 12, which in the embodiment shown has a cylindrical main portion 14 and depending therefrom a cylindrical base portion 16. A recess 18 formed in the top of the main portion 14 of the housing is shaped to detachably receive the base of the bulb 20. The bulb 20 shown illustratively is a fluorescent unit having a U-shaped glass envelope in which light is fluorescently generated. Both ends of the envelope are mounted on a base which has the shape of a T as seen from the side, and from the arms of which extend downward two electrical connector pins. The recess 18 is shaped to receive substantially the entire base of the type of bulb for which the adapter in question is designed.

The ballast choke used with fluorescent and other types of bulbs is provided in the cylindrical portion 14 of housing 12, and in the adapter shown in FIG. 1 is manufactured in the shape of a torus surrounding the recess 18. The starter and capacitor for the electrical circuitry of the adapter 10 are preferably housed in the cylindrical base 16, which is provided with a cylindrical electronically conductive sleeve 22 fitted over and secured in any suitable fashion to the lower end of the cylindrical base 16. The sleeve 22 has on its external surface threads to permit the adapter 10 to be screwed into a standard screw socket of the type used with incandescent lamps. The sleeve 22 serves to achieve electrical contact with such a socket. An additional electrical contact 24 is provided at the lower tip of the cylindrical base 16, protruding through an aperture in sleeve 22, from the conductive material of which it is spaced. In use, contact 24 is in electrical contact with the other contact of such a socket.

The recess 18 is formed with holes for receiving the connector pins of the bulb 20, in which holes are provided contact pieces 21 to make electrical contact with the pins.

The electrical connections of the circuit elements described (the choke, starter, capacitor, sleeve, tip contact, and contacts for the contact pins of the bulb) are well known to those skilled in the art. The external threaded sleeve 22 is connected to the winding of the choke, the other end of which is connected to a contact piece 21 that received one of the connector pins of the bulb 20. The other connector pin is received in engagement with a similar contact piece 21, which is connected to one terminal of each of the capacitor 23 and the starter 25. The other terminal of the capacitor and the starter is connected to tip contact 24 on the exterior of the housing 12.

The toroidal ballast choke 30 used in the socket adapter of FIG. 1 is shown in FIGS. 2 through 4 and comprises conductive windings 32 on two magnetic cores 34, each of which in the embodiment shown defines approximately a hemi-torus. Each winding 32 is insulated from its respective core 34 by a layer of insulative material 36, which, as can be seen from the figures, does not extend all the way to either free end of the core 34. The reason for this feature is explained below.

Figure 8:
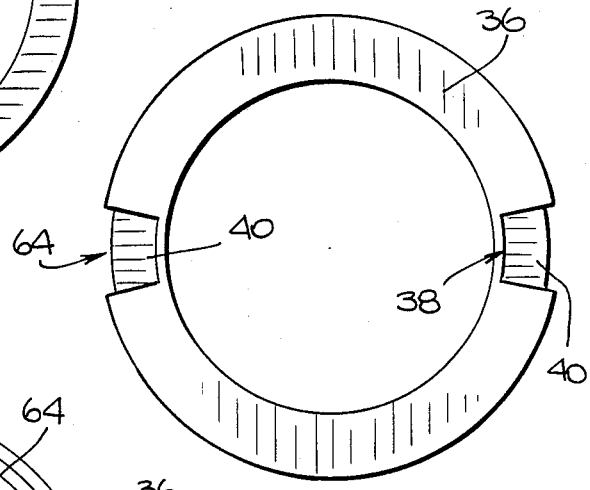
FIG. 8 is a top view of one half of the core of FIG. 5.
Figure 6:
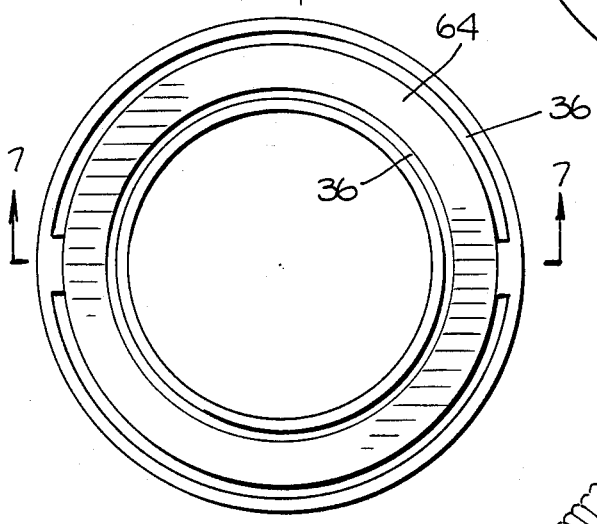
FIG. 6 is a schematic top view of a mold containing the core of FIG. 5, to illustrate the formation of an insulative coating on the core by one version of the process of the invention.
Figure 9:
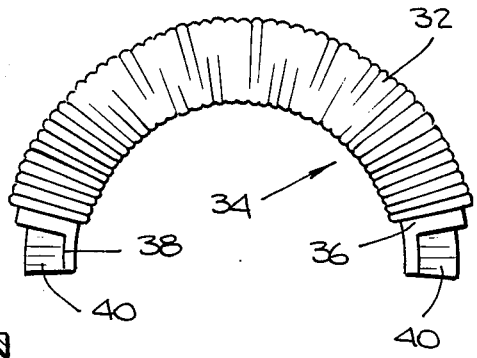
FIG. 9 is a top view of the half core of FIG. 8 after winding.
Figure 7:
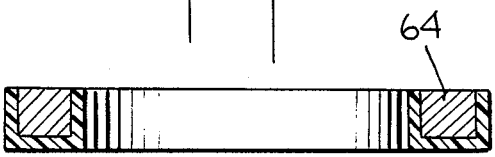
FIG. 7 is a cross-sectional view of the mold of FIG. 6, taken from line 7—7 in FIG. 6.

One obstacle to the practical use of toroidal cores for ballast chokes in the past has been the difficulty of manufacturing toroidal chokes reliably and with reasonable economy. The illustrated choke, however, lends itself readily to simple, reliable and inexpensive manufacture (see FIGS. 5 through 9). Initially, a toroidal core of a suitable conventional magnetic material is provided. A steel tape-wound core is suitable. The toroidal core is provided with a coating 36 of an electrically insulative material, which covers the top, bottom, inner and outer surfaces of the torus. However, only one surface, for example the inner surface 38 or perhaps better the outer surface is completely covered by coating 36 around the entire circumference of the torus. The other three surfaces are covered entirely except for two locations 40, preferably diametrically opposed, at which the core is left completely exposed except on the inner surface 38, or the outer surface, as the case may be. If desired, the core can be left exposed at 40 on all surfaces. The insulative layer 36 is preferably provided by means of injection molding, although any other suitable manner of formation can be substituted according to convenience.

The most preferred method of forming the insulative coating 36 is by injection molding the insulative material, which may suitably be nylon purely by way of example, around the core in a mold shaped to leave the exposed areas 40 at the desired locations.

An alternative method is to pour the material into an open-topped mold with the core inside. In the latter case, the mold is made of a flexible material such as silicone, by way of example, and is flexed by any suitable means to release the core and insulative layer from the mold after setting of the insulative material. An example of such a mold is shown schematically in FIGS. 6 and 7, in which the mold portions 41 for forming exposed areas 40 are visible. The portions 41 also support the core above the bottom of the mold. If injection molding is used, as is preferred, the mold used will be similar to that shown in FIGS. 6 and 7 with modifications clear to those in the art.

According to another alternative, which is not preferred but is nonetheless within the scope of the invention, the insulative layer can be provided by dipping the original core into a bath of the insulative material, drying the resulting layer, for example in an oven, and blowing off excess liquid. After the cutting, dust of the insulative material is blown onto the core while the latter is at an elevated temperature, to round the edges to prevent damage to the winding when the latter is formed.

The toroidal core is then cut in two through the exposed locations 40, resulting in two hemi-toroidal cores, or "C" cores, 34 as shown in FIG. 3. The cutting is preferably effected by means of a milling machine, which has been found to do the cutting efficiently and with relatively low heat production, but any other method desired can be substituted and is within the scope of the invention, considered most broadly. Each of the cores 34 is then separately provided with its respective winding 32. Because each of the cores 34 has the shape (as seen from above) of a circular arc, i.e., has a center line that defines a semi-circle or other portion of a circle, the windings can be applied in a very simple and economical fashion. The arcuate core 34 is supported by being gripped at one end, and is rotated in the plane of the arc about the axis defining the center of the arc, viz., along the length of the core itself. As this movement is carried out, a wire is wrapped around the core, producing the desired winding 32. The ends of the wire 50 are secured during the winding process in any suitable fashion within the ordinary skill in the art. After the windings 32 have been wrapped, the ends thereof are permanently secured in place by known expedients to provide two hemi-toroidal chokes. If desired, the cores of the two hemi-toroidal chokes can also be joined, by fish paper or other suitable known materials, to form a complete torus again. A system for especially easily carrying out the described winding process is described in greater detail in copending application Ser. No. 681,120, filed on even date herewith and assigned in common with the present application.

It will be appreciated by those skilled in the art that the substantially radially symmetric design of the choke 30 is not essential to the invention. Less compact, but still practical, variations can be adopted depending upon the design convenience and esthetic considerations. In particular, the choke may be not only strictly toroidal but annular, i.e., polygonal or oval, or have other configurations. Also, it is not essential to the invention that the two exposed portions 40 of the original toroidal core be diametrically opposite, but that location makes cutting the core into two pieces especially easy, and the winding process is simplified by making the two pieces of the original core substantially the same size and shape. However, either or both of the two cores 34 into which the original core is cut may, if desired, define less than 180 degrees of a circle, if the resulting manufacturing complexities are acceptable. Similarly, one core may be cut to less than 180 degrees while the other is cut to more than 180 degrees.

Also, the division of the original toroidal core into two pieces is preferably done after the provision of the insulative layer, and this sequence is necessary with a tape-wound core to preserve it intact. The reverse order is also within the scope of the invention, however.

While the present invention has been described in detail with reference to the preferred embodiments thereof, many modifications and variations thereof will not be apparent to those skilled in the art. Accordingly, the present invention is to be limited, not by the details of the embodiment illustratively described herein, but only by the terms of the appended claims.

What is claimed is:

1. A process for the manufacture of a choke, comprising the steps of:

providing a layer of an insulative material on an annular core of a magnetic material, said annular core having at least two distinct surfaces each extending around the entire circumference of the core, said layer-providing step being performed in such a manner that the layer covers all of one surface of the core and leaves at least two portions of at least one other surface of the core uncovered;

dividing the core into at least two piece by dividing the core at each of the two uncovered portions;

winding a wire of an electrically conductive material to form a respective winding on each of the pieces; and connecting the respective windings in series and mechanically joining the pieces to form a ballast choke which is a complete annulus.

2. The process of claim 1, wherein the layer-providing step is performed before the dividing step.

3. The process of claim 1, wherein the layer-providing step comprises injection-molding the insulative material to form the layer.

4. The process of claim 1, wherein the layer-providing step comprises introducing the insulative material into a flexible mold to form the layer, and flexing the mold to release the core after the insulative material has set.

5. The process of claim 1, wherein the dividing step is performed by means of milling.

6. The process of claim 1, wherein the core is toroidal.

7. The process of claim 1, further comprising the step of installing the ballast choke in a housing having a recess therein to receive the base of a bulb, said installing being performed in such a manner that the ballast choke surrounds the recess.

* * * * *

UNITED STATES PATENT AND TRADEMARK OFFICE

CERTIFICATE OF CORRECTION

PATENT NO. : 4,782,582

DATED : November 8, 1988

INVENTOR(S) : JOSEPH VENEZIA

It is certified that error appears in the above-identified patent and that said Letters Patent is hereby corrected as shown below:

COLUMN 1

Line 52, "Ser. No. 681,102" should read --Ser. No. 681,002--.

COLUMN 2

Line 47, "socket adaptor 10" should read --socket adapter 10--.

COLUMN 5

Line 17, "not" should read --now--.

COLUMN 6

Line 3, "two piece" should read --two pieces--.

Signed and Sealed this

Twenty-second Day of August, 1989

*Attest:*

DONALD J. QUIGG

*Attesting Officer*

*Commissioner of Patents and Trademarks*